United States Patent [19]

Pawlik et al.

[11] Patent Number: 4,875,068

[45] Date of Patent: Oct. 17, 1989

[54] INTEGRATED FUSER CONNECTOR AND ALIGNMENT MEMBER

[75] Inventors: Robert S. Pawlik; Kenneth R. Rasch, both of Webster, N.Y.

[73] Assignee: Xerox Corporation, Stamford, Conn.

[21] Appl. No.: 147,941

[22] Filed: Jan. 25, 1988

[51] Int. Cl.[4] ..... G03G 15/00; H05B 01/00; H01C 10/16

[52] U.S. Cl. ..... 355/286; 219/216; 338/316

[58] Field of Search ..... 355/3 FU, 14 FU; 219/216, 532, 541, 542; 338/316; 361/355, 361; 200/302.1

[56] References Cited

U.S. PATENT DOCUMENTS

| | | | |
|---|---|---|---|
| 3,634,598 | 8/1970 | Stanfield | 200/302.1 X |
| 4,092,562 | 5/1978 | Campbell | 315/189 |
| 4,197,445 | 4/1980 | Moser | 219/216 |
| 4,353,610 | 10/1982 | Deters | 339/19 |
| 4,504,891 | 3/1985 | Mazis | 362/219 |
| 4,541,708 | 9/1985 | Shigenobu | 355/3 FU |

*Primary Examiner*—Arthur T. Grimley
*Assistant Examiner*—Edward Pipala
*Attorney, Agent, or Firm*—Ronald F. Chapuran

[57] ABSTRACT

The present invention is a fuser assembly having a molded housing with a plurality of integral posts disposed along a first surface, an elongated electrically conductive contact strip having at least one set of integral, oppositely disposed spring clips and a pair of upright extending tabs, the spring clips engaging opposite sides of one of the integral posts to secure the contact strip to the housing and align the strip within the housing, a fuser roll with an associated electrical heating element disposed within the housing, one end of the heating element being secured to the end of one of the upright extending tabs, and a thermal cut-off element electrically connected to the heating element with one end of the thermal element secured to an end of the second upright extending tab.

5 Claims, 3 Drawing Sheets

INTEGRATED FUSER CONNECTOR AND ALIGNMENT MEMBER

BACKGROUND OF THE INVENTION

The present invention relates to a fuser of an electrostatic printer, and more particularly, to an integrated fuser connector and alignment elements.

The process of transferring an electrostatic latent imatg in an electrostatic printer includes the step of first forming an image on the surface of a dielectric receptor by selectively discharging the surface of the receptor by a suitable ion projection device. The latent electrostatic image on the receptor is then suitably developed with a toner material, transferred to a copy sheet by bringing the copy sheet into intimate contact with the developed image on the receptor, and then fixing the toner image to the copy sheet in a fuser device.

A fuser device is a relatively complicated mechanism requiring various electrical connections and contacts from a power source to the heating element such as a heating lamp, to a fuse or thermal cut-off device, and to a thermister or temperature sensor to monitor the fuser temperature. In addition, the heating element must be properly located with respect to the fuser roll, and the thermal cut-off device and other electrical components must be properly aligned and mounted with respect to the fuser roll.

Various integrated connector and conducting strip arrangements are disclosed in the prior art. For example, U.S. Pat. No. 4,092,562 discloses a compact integral assembled lamp unit including end connectors for connecting a plurality of lamps together. U.S Pat. No. 4,353,610 discloses an electrical conducting strip including a plurality of spaced apart opening arrangements adapted to connect to terminal posts. Each opening arrangement includes an access opening and an engaging opening. U.S. Pat. No. 4,504,891 discloses a molded plastic plate holding lamp socket contacts and wiring connector pins, and a printed wiring circuit plate making electrical contact with the socket contacts and the connector pins through mechanical pressure contact. The wiring and electrical connections in the above systems can be relatively complicated and require a relatively complex assembly operation.

It would be desirable, therefore, in a fuser heating system to eliminate conductors and contacts, and simplify the internal wiring and heating element mounting.

It is an object of the present invention therefore to provide a new and improved fuser integrated electrical contact and mounting system. It is another object of the present invention to provide electrical contact strips in a fuser housng, the electrical strips providing mounting and positioning means for various electrical devices within the housing, and to provide a fuser housing having alignment means to locate the contact strips and other electrical devices within the housing. Further advantages of the present invention will become apparent as the following description proceeds and the features characterizing the invention will be pointed out with particularity in the claims annexed to and forming a part of this specification.

SUMMARY OF THE INVENTION

Briefly, the present invention is a fuser assembly having a molded housing with a plurality of integral posts disposed along a first surface, an elongated electrically conductive contact strip having at least one set of integral, oppositely disposed spring clips and a pair of upright extending tabs, the spring clips engaging opposite sides of one of the integral posts to secure the contact strip to the housing and align the strip within the housing, a fuser roll with an associated electrical heating element disposed within the housing, one end of the heating element being secured to the end of one of the upright extending tabs, and a thermal cut-off element electrically connected to the heating element with one end of the thermal element secured to an end of the second upright extending tab.

DESCRIPTION OF THE DRAWINGS

For a better understanding of the present invention, reference may be had to the accompanying drawings wherein the same reference numerals have been applied to like parts and wherein.

DETAILED DESCRIPTION OF THE INVENTION

Figure 1:
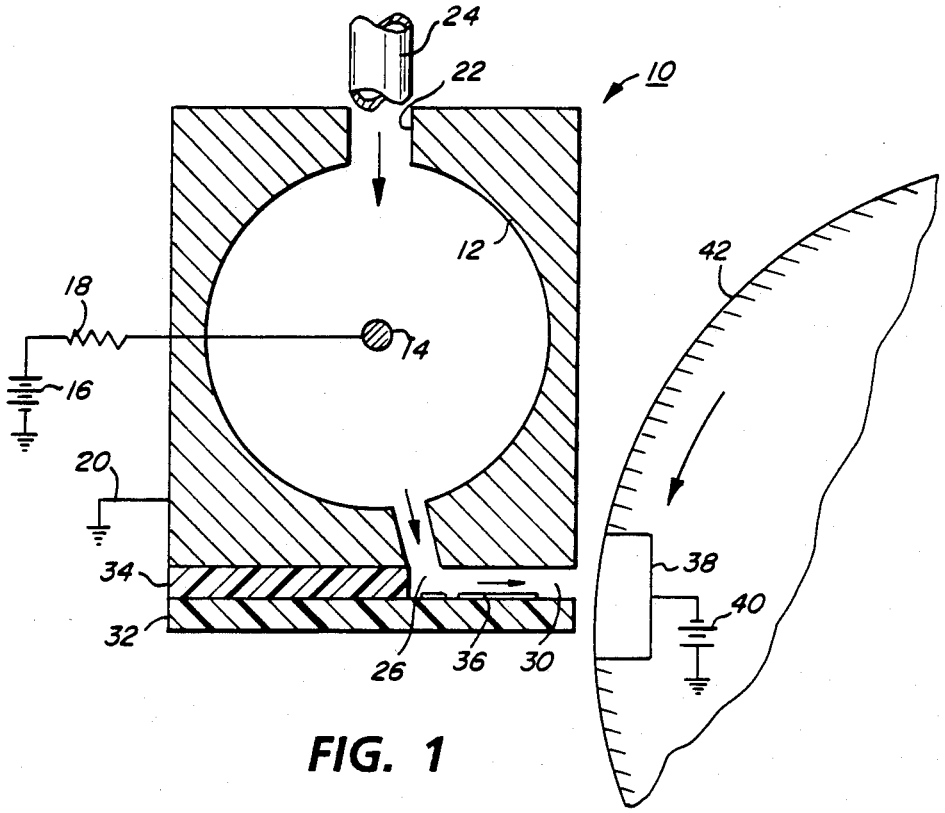
FIG. 1 is a schematic of a printhead for use with the present invention.

With particular reference to the drawings, there is illustrated in FIG. 1 a housing 10 which includes an electrically conductive, elongated chamber 12 and a corona discharge wire 14, extending along the length of the chamber. A high potential source 16, on the order of several thousand volts dc, is connected to the wire 14 through a suitable load resistor 18, and a reference potential source 20 (which may be ground) is connected to the wall of chamber 12. Upon application of the high potential to corona discharge wire 14, a corona discharge surrounds the wire, creating a source of ions of a given polarity (preferably positive), which are attracted to the grounded chamber wall and fill the chamber with a space charge.

An inlet channel 22 extends along the chamber substantially parallel to wire 14 to deliver pressurized transport fluid (preferably air) into the chamber 12 from a suitable source, schematically illustrated by the tube 24. An outlet channel 26, from the chamber 12, also extends substantially parallel to wire 14, at a location opposed to inlet channel 22, for conducting the ion laden transport fluid to the exterior of the housing 10. The outlet channel 26 comprises two portions, a first portion directed substantially radially outwardly from the chamber and a second portion 30 angularly disposed to the first portion. The second portion 30 is formed by the unsupported extension of a marking head 32 spaced from and secured to the housing by insulating shim 34. As the ion laden transport fluid passes through the outlet 26, it flows over an array of ion modulation electrodes 36, each extending in the direction of the fluid flow, and integrally formed on the marking head 32.

Ions allowed to pass completely through and out of the housing 10, through the outlet channel 26, come under the influence of accelerating back electrode 38 which is connected to a high potential source 40, on the order of several thousand volts dc, of a sign opposite to that of the corona source 16. An insulating charge receiver 42, or dielectric receptor is interposed between the accelerating back electrode and the housing, and is moved over the back electrode for collecting the ions upon its surface in an image configuration. Once the ions have been swept into the outlet channel 26 by the transport fluid, it becomes necessary to render the ion-laden fluid stream intelligible. This is accomplished by selectively controlling the potential on modulation electrodes 36 by any suitable means.

As described in U.S. Pat. No. 4,463,363, incorporated herein once the ions in the transport fluid stream come under the influence of the modulation electrode, they may be viewed as individual "beams", which may be allowed to pass to the receiver 42 or to be suppressed within the outlet channel. "Writing" of a single spot in a raster line is accomplished when the modulation electrode is selectively connected to a potential source at substantially the same potential as that on the opposing wall of the outlet channel. With both walls bridging the channel being at about the same electrical potential, there will be substantially no electrical field extending there across. Thus, ions passing therethrough will be unaffected and will exit the housing to be deposited upon the charge receptor.

Conversely, when a suitable potential is applied to the modulation electrode, a field will extend across the outlet channel to the opposite, electrically grounded, wall. If the electrical potential imposed on the modulation electrode is of the same sign as the ions, the ion "beam" will be repelled from the modulation electrode to the opposite wall where the ions may recombine into uncharged, or neutral, air molecules. If the electrical potential imposed on the modulation electrode is of the opposite sign as the ions, the ion "beam" will be attracted to the modulation electrode where they may recombine into uncharged or neutral, air molecules, Therefore, that "beam" of transport fluid, exiting from the housing in the vicinity of the modulation electrode, will carry substantially no "writing" ions.

An imagewise pattern of information will be formed by selectively controlling each of the modulation electrodes in the array so that the ion beams associated therewith either exit or are inhibited from exiting the housing in accordance with the pattern and intensity of light and dark spots of the image to be reproduced.

Figure 2:
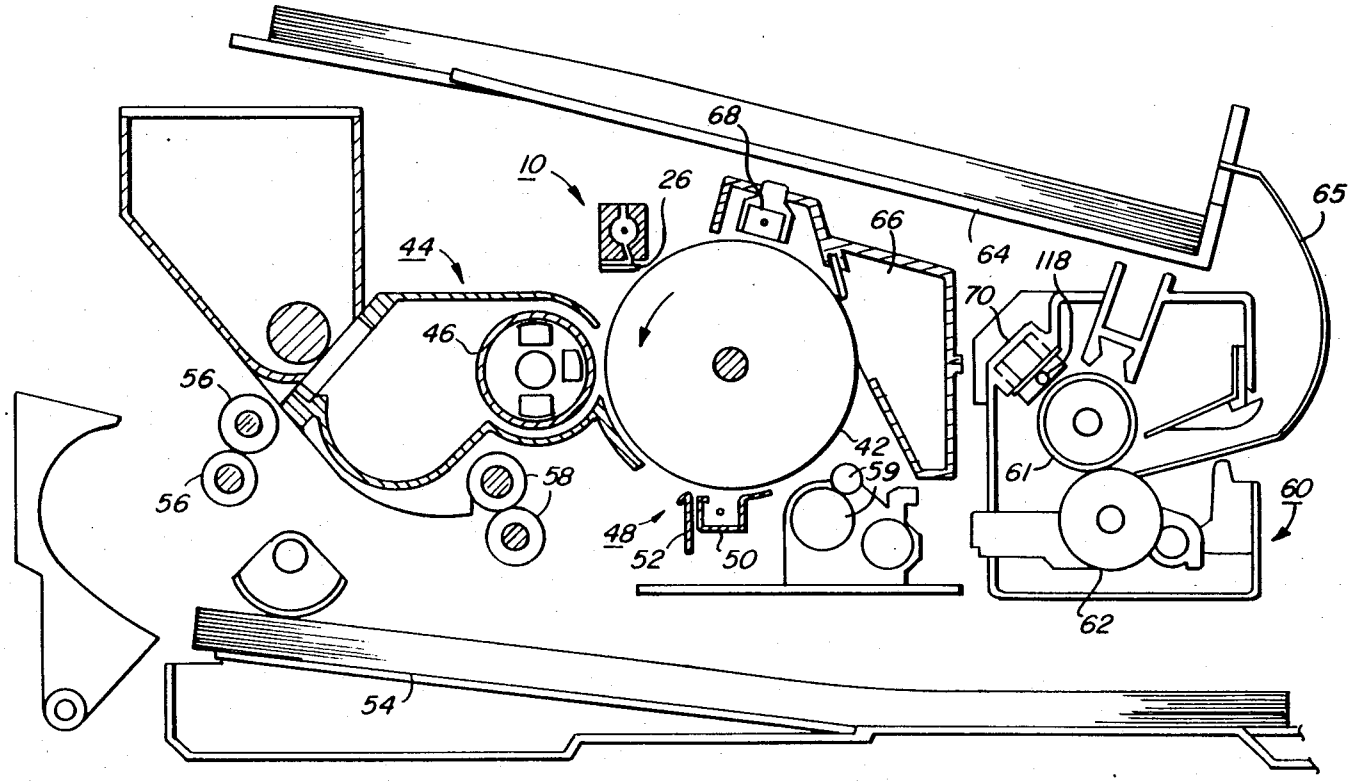
FIG. 2 is a schematic elevational view depicting an electrographic printing machine incorporating the present invention.

With reference to FIG. 2, there is disclosed in general a printing apparatus in accordance with the present invention. Initially, the receiver 42, a substrate supporting any suitable electrostatic material is charged to a background voltage, in a preferred embodiment, approximately −1500 volts. The receiver 42 is rotated in a direction of the arrow passed the outlet channel 26 of the fluid jet assisted ion projection apparatus. The charge pattern corresponding to the image to be reproduced is projected onto the surface of the receiver 42 providing a latent image. Upon further rotation of the receiver to a developer station (generally shown at 44); suitable developer rolls 46 such as magnetic development rolls advance a developer material into contact with the electrostatic latent image. The latent attracts toner particles from the carrier granules of the developer material to form a toner powder image upon the surface of the receiver.

The receiver 42 then advances to a transfer station shown generally at 48 where a copy sheet is moved into contact with the powder image. The transfer station 48 includes a transfer corotron 50 for spraying ions onto the backside of the copy sheet and a pretransfer baffle generally shown at 52. Copy sheets are fed from selected trays, for example, tray 54 and conveyed through a suitable copy sheet paper path, for example, driven by suitable rolls such as rolls 56 and 58 to the transfer station 48.

After transfer, the copy sheets are driven via rolls 59 to a fuser shown generally at 60 including fusing rolls for permanently affixing the transferred powder image to the copy sheets. Preferably, the fuser assembly 60 includes a heated fuser roll 61 and backup or pressure roll 62 with the sheet passing therebetween. After fusing, the copy sheet is transported to a suitable output tray such as illustrated at 64 via channel 64. In addition, a suitable cleaner 66, for example, a blade cleaner in contact with the receiver surface removes residual particles from the surface. Finally, an erase scorotron 68 neutralizes the charge on the receiver and recharges the receiver 42 to the background voltage.

Figure 5:
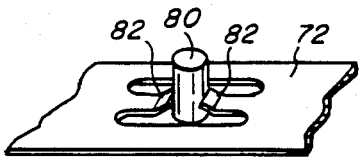
FIG. 5 is an enlarged view of the post and spring clip assembly in accordance with the present invention.
Figure 3:
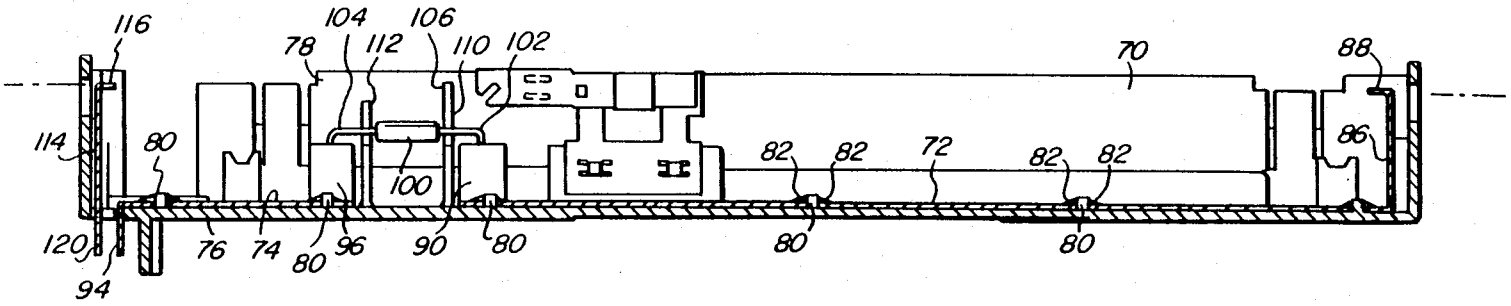
FIG. 3 is a side view of the cover assembly of a fuser incorporating the present invention.
Figure 4:
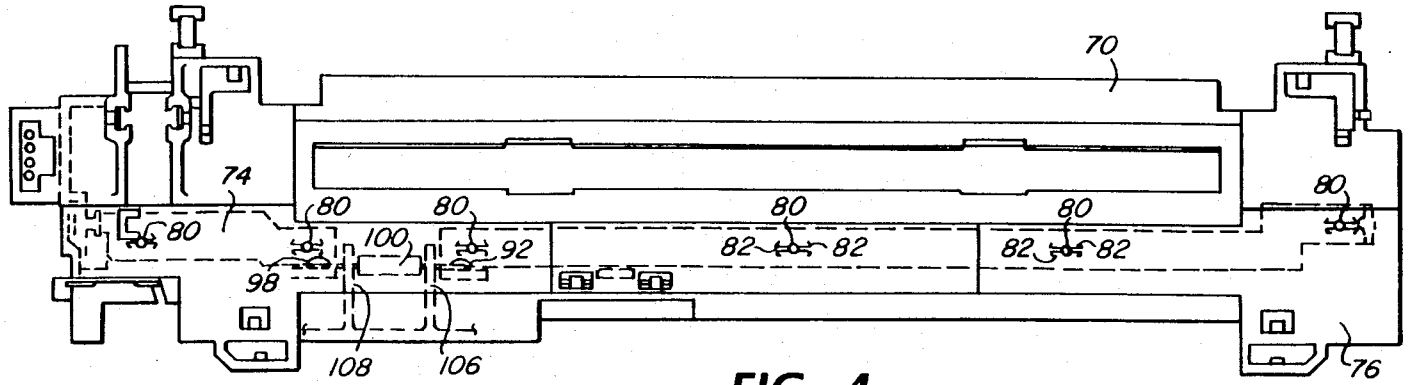
FIG. 4 is a top view of the cover assembly of the fuser incorporating the present invention.

With reference to FIGS. 3, 4 and 5 there is illustrated a portion of the fuser 60 including a top housing cover 70 and contact strips 72, 74 in accordance with the present invention. In particular the top housing cover 70 includes a top wall 76 and a side wall 78, the top wall 76 having a plurality of integral posts 80 spaced in a generally linear relationship. The first contact strip 72 includes a plurality of oppositely disposed pairs of relatively thin and flexible spring clips 82 displaced along the contact strip 72 in alignment with posts 80.

Each pair of spring clips 82 includes first and second oppositely disposed and members integral with the contact strip, each of the ends of the integral members terminating to define a space therebetween. The contact strip 72 is secured to the underside of the top wall 76 by pushing the integral posts 80 through the space defined by the ends of the integral members of the spring clips 82, the spring clips pressing against the posts 80 to secure the contact strip 72 to the housing cover 70. Thus, suitably located integral post 80 align and position the contact strip 72 within the housing cover 70. The relationship of a post 80 and a pair of spring clips 82 is shown in greater detail in FIG. 5.

Extending from one end of the contact strip 72 is a leg 86 terminating in a tab support 88. The other end of the contact strip 72 includes a second leg 90 supporting an arcuate projection 92 defining a hole. The second contact strip 74 also includes a plurality of pairs of spring clips 82 secured to integral posts 80.

The second contact strip 74 further includes a pair of vertically extending legs 94 and 96, the vertically extending leg 94 projecting through the housing cover 70 to form one part of an electrical plug to interconnect to a power source, and the leg 96 also supporting an arcuate projection 98 defining a hole. A fuse or thermal cut-off device 100 having wire connectors 102 and 104 is electrically connected to the contact strips 72, 74 having wire 102 inserted in the hole defined by the arcuate projection 92 on leg 90 of contact strip 72 and wire connector 104 inserted into the hole defined by the arcuate projection 98 on the leg 96 on the contact strip 74.

Extending from the top and side walls 76, 78 of cover 70 are a pair of flat, spaced plates 106 and 108, portions of the plates 106 and 108 defining circular surfaces 110 and 112 supporting the wire connectors 102, 104 of the thermal cut-off device 100. The plates 106, 108 position the thermal cut-off device 100 with respect to the fuser roll 61. A fuser lamp (not shown) is suitable connected to the L-shaped legs 86 to position the fuser lamp with respect to the fuser roll 64. A third contact strip 114 terminates in a tab support 116 for engaging and supporting one end of the fuser lamp 118 illustrated in FIG. 2. The opposite end of the third contact strip 118 extends through housing cover 70 forming another leg 120, to pair with leg 94 providing the contacts of the electrical plug to form the outside connection to the power source for the lamp 118.

In the fabrication of the fuser assembly, the fuser cover 70 is molded with integral posts 80 and flat plates 106, 108. The contact strip 72 is suitably secured to the inside wall of the cover 70 by fitting the spaced spring clips 82 into engagement with the integral posts 80 to rigidly secure the contact strip 72 to the cover 70. In a similar manner the contact strip 74 is secured to the cover 70 by engaging the spring clips to the integral posts. This aligns the contact strips 72 and 74 within the housing 70 and the legs 90 of the contact strips 72 and 74 along with the spaced plates 106 and 108 align the thermal cut-off device 100 in proper spacing relationship with the fuser roll 61. Specifically when the contact strip 114 is secured and aligned to the cover 70, the thermo cut off 100 is fastened to the cover 70. In particular the wire connector 102 is inserted into the hole defined by projection 92 on leg 90 at the wire connector 104 and inserted into the hole defined by projection 98 on leg 96. The connectors 102, 104 of thermo cutoff 100 are biased into engagement with circular surfaces 110, 112 to position the thermo cut off with respect to fuser roll 61. Each end of lamp 118 is attached to a tab support 88, 116 to secure the lamp within the cover 70, connect the lamp to a power source, and also align the lamp 118 with respect to fuser roll 61.

While there has been illustrated and described what is at present considered to be a preferred embodiment of the present invention, it will be appreciated that numerous changes and modifications are likely to occur to those skilled in the art, and it is intended in the appended claims to cover all those changes and modifications which fall within the true spirit and scope of the present invention.

We claim:

1. A fuser assembly in a printing machine comprising:

a molded, essentially rectangularly shaped housing having a plurality of integral posts disposed along a first surface of the housing, an elongated flat, electrically conductive contact strip having at least one set of integral, oppositely disposed spring clips and a first and a second upright extending tab, the spring clips engaging opposite sides of one of said plurality of integral posts to secure the contact strip to the housing and align the contact strip within the housing, a fuser roll with an associated electrical heating element disposed in proximity to the housing, one end of the heating element being secured to the distal end of the first upright extending tab, and a thermo cutoff element, the thermo cutoff element being electrically connected to the heating element, one end of the thermo cutoff element being secured to the distal end of the second upright extending tab.

2. The fuser assembly of claim 1 wherein the the second upright extending tab includes an integral, arcuate shaped member defining a hole and one end of the thermo cutoff device is a metallic wire, the metallic wire disposed within the hole to secure the cutoff element to the contact strip.

3. The fuser assembly of claim 1 wherein one wall of the housing includes an integral, inwardly-extending support, said second upright extending tab biasing the thermo cutoff device against said support.

4. The fuser assembly of claim 3 wherein the fuser roll includes an outer surface, said support positioning the thermo cutoff device in close proximity to said outer surface.

5. The fuser assembly of claim 4 wherein the support includes an alignment surface engaging the thermo cutoff element, said alignment surface defining an arc.

* * * * *